United States Patent [19]

Amberg

[11] 4,282,608

[45] Aug. 11, 1981

[54] LINER FOR TROUSERS OR SKIRT

[76] Inventor: Eduard Amberg, Birsigstr. 107, 4054 Basel, Switzerland

[21] Appl. No.: 76,563

[22] Filed: Sep. 18, 1979

[30] Foreign Application Priority Data

Sep. 19, 1978 [DE] Fed. Rep. of Germany ..... 2840639

[51] Int. Cl.[3] ..... A41D 1/06

[52] U.S. Cl. ..... 2/227

[58] Field of Search ..... 2/227, 223, 228, 230, 2/238, 400, 211

[56] References Cited

U.S. PATENT DOCUMENTS

| | | | |
|---|---|---|---|
| 711,666 | 10/1902 | Loewenbach | 2/230 |
| 1,271,248 | 7/1918 | Walcoff | 2/227 |
| 1,468,072 | 9/1923 | Ogle | 2/227 X |
| 1,490,470 | 4/1924 | Laubach | 2/227 |
| 1,752,217 | 3/1930 | Weinstein | 2/227 X |
| 3,127,896 | 4/1964 | Puliafico | 2/227 X |

FOREIGN PATENT DOCUMENTS

| | | | |
|---|---|---|---|
| 322221 | 6/1957 | Switzerland | 2/230 |

*Primary Examiner*—H. Hampton Hunter
*Attorney, Agent, or Firm*—Karl F. Ross

[57] ABSTRACT

A liner for an outer garment of the lower body has a trunk portion with a waistband to which a ribbon is internally fastened at numerous peripherally spaced locations so as to form loops through which vertical straps on the inside of the garment, provided with snap fasteners or the like, can be drawn. When the garment is a pair of trousers or slacks, the trunk portion of the liner ends in a pair of tubular extensions snugly fitted into the trouser legs.

3 Claims, 4 Drawing Figures

LINER FOR TROUSERS OR SKIRT

FIELD OF THE INVENTION

My present invention relates to a liner for an outer garment of the lower body, such as a pair of trousers or a skirt.

BACKGROUND OF THE INVENTION

In my prior U.S. application Ser. No. 756,842 filed Jan. 5, 1977, now abandoned, as well as in my corresponding German application Ser. No. 2 601,807 and Swiss Pat. No. 603,085 I have disclosed a liner of this type designed to fit closely into a pair of trousers for the purpose of absorbing perspiration and preventing direct contact between the trousers and the skin of the wearer.

According to these prior disclosures, the trousers and the liner are provided with respective waistbands one of which carries buttons while the other has corresponding buttonholes to facilitate a detachable connection between these two members, allowing the liner to be used with different pairs of trousers. The possibility of using slide fasteners or sliding loops has also been suggested in a general manner, without specific directions as to how they might be applied.

I have now found that the use of buttons and buttonholes has the drawback that, owing to unavoidable divergences in their spacings on different garments, problems of fit arise when a given liner is to be transferred from one pair of trousers to another. The same is true of slide fasteners.

OBJECT OF THE INVENTION

Thus, the object of my present invention is to provide means for detachably securing a liner of the aforedescribed character to an outer garment such as a pair of trousers, slacks or tennis shorts, a skirt, or the like.

SUMMARY OF THE INVENTION

I realize this object, pursuant to my present invention, by providing the trunk portion of a liner of this description with a waistband and with a substantially coextensive ribbon (or a group of aligned ribbons of lesser length) attached thereto at a multiplicity of peripherally spaced locations whereby a series of intervening loops are formed therebetween, these loops being engageable by generally vertical flexible straps each having at least one free end by which it can be fastened to its opposite end after insertion into such a loop to hold the liner in place. The straps are attached to the associated garment at waist level.

Thus, the free end of the strap and its other end, secured to the inner surface of the garment, may be provided with complementary snap-fastener halves or with similar fastening means, e.g. those of the hook-and-loop type known as Velcro. Alternatively, each strap may be attached to the garment at an intermediate point so as to have free upper and lower ends which may be tied, like a shoelace, after one of them has been pulled through a loop of the liner.

Advantageously, the number of loops on the liner exceeds the number of straps on the garment while the length of each loop exceeds the width of the straps. This allows the straps to be inserted into any of several closely spaced loops, with limited adjustability in peripheral direction. If, for example, the waistband of the liner has a length of 90 cm and the ribbon is fastened thereto by seams spaced 3 cm apart, there will be 30 loops 3 cm in length; with straps about half as wide, there will be sufficient play for, say, eight straps to find loops aligned therewith even if the relative position of the straps varies from one garment to another.

According to a more particular feature of my invention, the ribbon or ribbons are attached to the inner surface of the waistband of the liner whose upper edge is thereby overhung by the straps coming in from above. The liner is thereby safely suspended from the garment at a number of points with little relative vertical and horizontal mobility.

BRIEF DESCRIPTION OF THE DRAWING

The above and other features of my invention will now be described in detail with reference to the accompanying drawing in which.

SPECIFIC DESCRIPTION

Figure 2:
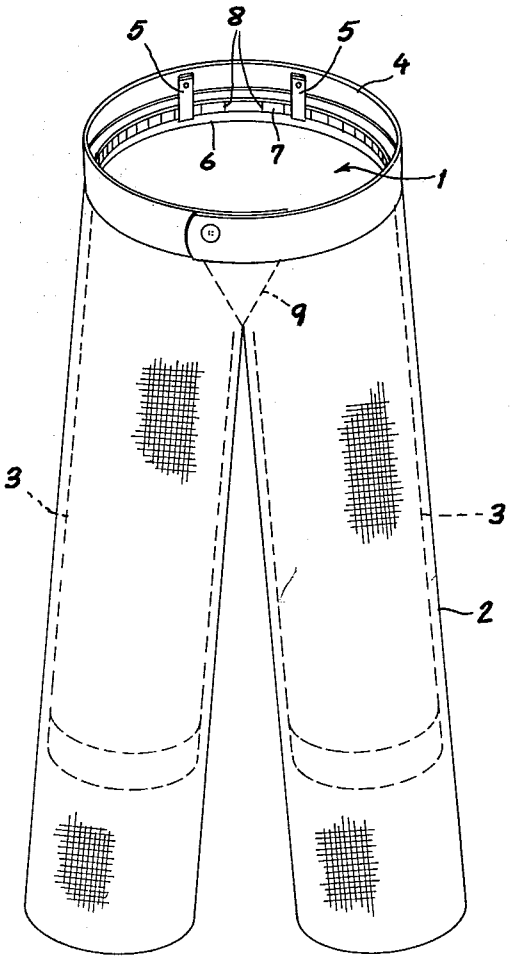
FIG. 2 is a similar view of a pair of trousers fitted with the liner of FIG. 1.
Figure 1:
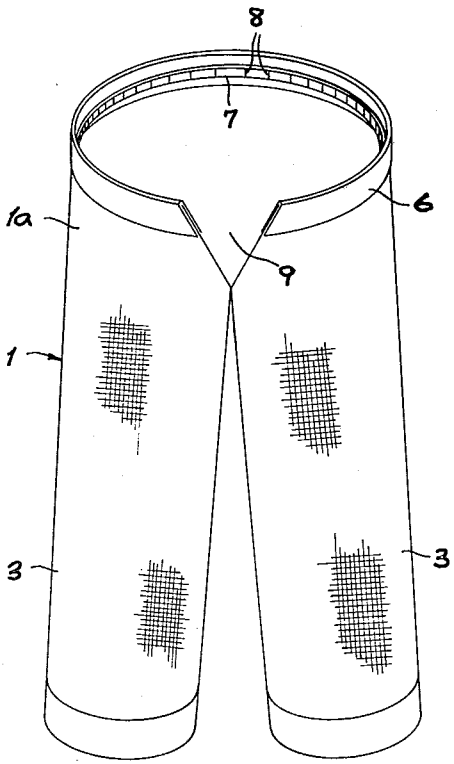
FIG. 1 is a perspective view of a liner according to my invention, designed for a pair of trousers.

In FIG. 1 I have shown a liner 1, similar to that of my prior disclosures indentified above, comprising a trunk portion 1*a* with a pair of tubular downward extensions 3 and a waistband 6. In accordance with my present invention, the waistband 6 carries along its inner surface a peripherally coextensive ribbon 7 stitched to it at equispaced seams 8 so as to form a series of loops along which the ribbon is separated from that band. A generally V-shaped, downwardly converging cutout 9 at the front of the liner 1, interrupting the ribbon and the waistband, registers with the fly of a pair of trousers 2 when the liner is inserted into same as shown in FIG. 2.

Figure 3:
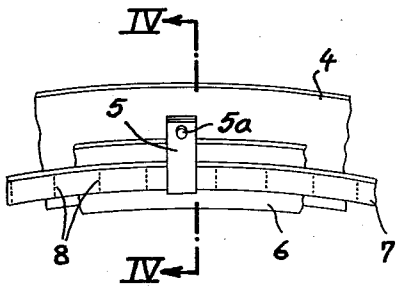
FIG. 3 is a fragmentary view, drawn to a larger scale, of the elements detachably joining the liner to the trousers.
Figure 4:
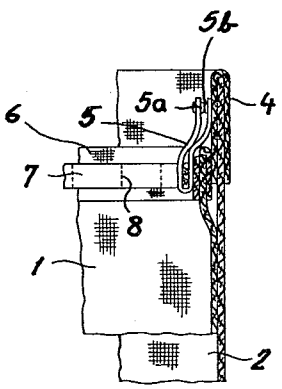
FIG. 4 is a sectional detail view taken on the line IV—IV of FIG. 3.

The top of trousers 2 has a waistband 4 substantially at the level of waistband 6 but of somewhat greater vertical width. Secured to waistband 4, as best seen in FIGS. 3 and 4, are a set of straps 5 which are substantially equispaced along its inner periphery and of which only two are visible in FIG. 2. The straps 5 are attached to the band 4 above the upper edge of band 6 and pass through selected loops of ribbon 7 aligned with them; the free and attached ends of each strap carry complementary snap-fastener halves 5*a*, 5*b* which close the strap to hold the liner 1 suspended by its ribbon 7. Since the straps 5 are narrower than the distance separating adjoining seams 8, they need not be precisely centered with reference to the associated loops.

The tubular extensions 3 of trunk portion 1*a*, converging slightly downward, fit closely into the trouser legs and therefore do not cling to the legs of the wearer. These extensions would of course be greatly foreshortened if the associated garment were a pair of trunks or shorts. If the garment is a skirt, they will generally be replaced by a slightly diverging unitary lower portion; in such a case, obviously, the cutout 9 may be omitted and the waistband 6 with its ribbon 7 may be completely annular.

While I have shown a single ribbon 7 of the same peripheral length as the waistband 6, it is to be understood that this ribbon could be divided into a number of disconnected sections each forming one or more loops, preferably the latter.

The liner 1 may be a perspiration-absorbing cotton fabric, for example, but could also be made from synthetic fibers.

I claim:

1. In a garment for the lower body provided with a liner removably fitted thereinto, said liner having a trunk portion including a waistband provided with substantially coextensive ribbon means internally attached thereto at peripherally spaced locations to form a multiplicity of intervening loops, said garment being internally provided at waist level with a plurality of generally vertical flexible straps having a free end engageable with its opposite end for holding said liner in position by closing said straps upon themselves, the improvement wherein said straps are attached to said garment at points above the upper edge of said waistband and overhang said upper edge on engaging said loops, said straps having a width less than the peripheral length of said loops, the number of said loops being substantially greater than that of said straps for facilitating selective peripheral adjustment of said liner relatively to said garment.

2. The combination defined in claim 1 wherein said garment is a pair of trousers, said liner having a pair of tubular extensions hanging down from said trunk portion and fitting closely into respective trouser legs.

3. The combination defined in claim 2 wherein said trunk portion has a downwardly converging cutout registering with a fly on said trousers, said waistband and said ribbon means being interrupted at said cutout.

* * * * *